US009285773B2

(12) United States Patent
Mertenat

(10) Patent No.: US 9,285,773 B2
(45) Date of Patent: Mar. 15, 2016

(54) TIMEPIECE BALANCE

(71) Applicant: ETA SA MANUFACTURE HORLOGERE SUISSE, Grenchen (CH)

(72) Inventor: Olivier Mertenat, Solothurn (CH)

(73) Assignee: ETA SA MANUFACTURE HORLOGÈRE SUISSE, Grenchen (CH)

( * ) Notice: Subject to any disclaimer, the term of this patent is extended or adjusted under 35 U.S.C. 154(b) by 0 days.

(21) Appl. No.: 14/517,097

(22) Filed: Oct. 17, 2014

(65) Prior Publication Data

US 2015/0036466 A1 Feb. 5, 2015

Related U.S. Application Data

(63) Continuation of application No. PCT/EP2013/057401, filed on Apr. 9, 2013.

(30) Foreign Application Priority Data

Apr. 19, 2012 (EP) ..... 12164691

(51) Int. Cl.

| | |
|---|---|
| ***G04B 15/08*** | (2006.01) |
| ***G04B 17/06*** | (2006.01) |
| ***G04B 15/14*** | (2006.01) |
| ***G04B 17/32*** | (2006.01) |

(52) U.S. Cl.

CPC ..... *G04B 15/08* (2013.01); *G04B 15/14* (2013.01); *G04B 17/06* (2013.01); *G04B 17/063* (2013.01); *G04B 17/32* (2013.01)

(58) Field of Classification Search

CPC ..... G04B 17/06; G04B 17/063; G04B 17/32; G04B 15/14; G04B 15/08

USPC ..... 368/130, 325, 127, 177, 124–126, 368/128–129, 131–138, 140, 147–151, 368/206–208

See application file for complete search history.

(56) References Cited

U.S. PATENT DOCUMENTS 1,333,161 A * 3/1920 Coats ..... G04B 18/023 368/127
1,423,446 A 7/1922 Needy (Continued)

FOREIGN PATENT DOCUMENTS

CH 95 065 A 6/1922
CH 270 582 A 9/1950

(Continued)

OTHER PUBLICATIONS

International Search Report of PCT/EP2013/057401 dated Sep. 6, 2013.

(Continued)

*Primary Examiner* — Edwin A. Leon
(74) *Attorney, Agent, or Firm* — Sughrue Mion, PLLC

(57) ABSTRACT

A balance staff including a main shoulder of a balance, a first radial lateral bearing surface for this balance, a roller sleeve shoulder, and a balance spring collet shoulder. The roller shoulder is adjacent to a first radial shoulder, the collet shoulder is adjacent to a second lateral surface, which defines, with the first radial shoulder, a collar including the balance shoulder which is adjacent to a first lateral bearing surface for the bearing of a balance, the first lateral bearing surface facing the same side as the first radial shoulder, the balance shoulder is separated from this collet shoulder by a seat forming the largest diameter of the collar.

8 Claims, 3 Drawing Sheets

(56) References Cited

U.S. PATENT DOCUMENTS

| | | | | |
|---|---|---|---|---|
| 3,791,251 | A * | 2/1974 | Pohlmann | G04B 17/063 368/130 |
| 9,188,956 | B2 * | 11/2015 | Nakajima | G04B 15/06 |
| 2010/0157743 | A1 | 6/2010 | Silva | |

FOREIGN PATENT DOCUMENTS

| | | | |
|---|---|---|---|
| CH | 474 101 | A | 2/1969 |
| CH | 700 260 | A2 | 7/2010 |
| DE | 24 27 021 | A1 | 1/1975 |
| FR | 1 216 100 | A | 4/1960 |
| GB | 831 161 | A | 3/1960 |

OTHER PUBLICATIONS

International Preliminary Report on Patentability dated Apr. 22, 2014 issued by the International Searching Authority in counterpart International application No. PCT/EP2013/057401.

* cited by examiner

TIMEPIECE BALANCE

This is a Continuation application in the United States of International Patent Application PCT/EP2013/057401 filed Apr. 9, 2013 which claims priority on European patent application No12164691.3 filed Apr. 19, 2012. The entire disclosures of the above patent applications are hereby incorporated by reference.

FIELD OF THE INVENTION

The invention concerns a timepiece movement including at least one combined unit formed of a sprung balance assembly and a pallet lever, said sprung balance assembly comprising an equipped balance including a balance, whose hub is mounted on an equipped staff; said equipped staff includes a roller sleeve, carrying a pin and at least one notch, and said roller sleeve being driven onto a shoulder of the roller of a timepiece balance staff, said staff including, about a main pivot axis:

a main shoulder for the radial centring of said balance, and, adjacent to said main shoulder, a first lateral bearing surface extending substantially radially and receiving said balance in axial abutment, a collet shoulder for the radial centring of a balance spring collet comprised in said sprung balance assembly, said collet shoulder and said main shoulder being at a distance from each other and arranged to maintain a distance from each other, said collet being mounted on said collet shoulder and said balance being mounted on said main shoulder, said staff forming a stepped hub including at both ends thereof, in proximity to end pivots, on the one hand, said roller shoulder, which is adjacent to a first radial shoulder, and on the other hand, said collet shoulder, which is adjacent to a second lateral surface, said first radial shoulder and said second lateral surface defining together a collar, said collar in turn including said main shoulder which is adjacent to said first lateral bearing surface for the axial bearing of said balance, and said first lateral bearing surface being turned to the same side as said first radial shoulder, and said balance shoulder being separated from said collet shoulder by a peripheral portion forming a seat, which forms the largest diameter of said collar and of said staff, the balance hub being mounted via a bore comprised in said main shoulder and also mounted bearing, via a first bearing surface of said balance, on said first lateral bearing surface, said hub being held, on a second surface of said balance axially opposite said first bearing surface, by a sharp rivet edge formed from a local deformation of a lip of said staff, said balance being confined between said first lateral bearing surface and said sharp rivet edge, the abutment limit of the balance being located on the opposite side to said roller shoulder and said sleeve being driven in on the opposite side to said balance relative to said sharp rivet edge, said balance spring collet, to which is attached at least one balance spring, being mounted by clamping on said staff and bearing in abutment on said second lateral surface, and said pallet lever being arranged to cooperate with said pin and said notch, and said pallet lever including a lever whose pivot defines a pallet lever pivot axis parallel to said main axis, said lever carrying a dart in the alignment thereof, and a set of horns arranged to cooperate with said pin as close as possible to said main shoulder, said dart being arranged to cooperate with said notch as far as possible from said main shoulder, and said set of horns being arranged in a substantially parallel plane to a plane defined by said lever and said dart.

The invention also concerns a timepiece including at least one such timepiece movement.

The invention concerns the field of timepiece mechanisms, and more specifically the field of combined units with a sprung balance and lever escapement mechanism.

BACKGROUND OF THE INVENTION

In a conventional mechanism, a balance staff carries a balance fixed via a hub of the balance felloe, and held bearing on a surface of a first side of a median seat of the balance staff. On this first side, beyond the hub, a collet fitted onto the staff in proximity to a first end thereof forms the moveable point of attachment of a balance spring which is also attached to a plate or bar. On the second side of the balance staff, opposite the side carrying the collet, the staff carries, away from the median seat, first of all a large roller carrying an impulse pin which cooperates with the pallet fork, then a small roller with a notch cooperating with a dart of the same pallet lever to prevent any accidental movements of the fork.

The safety devices should be of sufficient size in the transverse direction of the movement, i.e. parallel to the pivot axes of the balance and of the pallets. Particular attention must be given to the safety device between the surface of the large roller facing the pallets and the corresponding surface of the lever which carries the horns delimiting the pallet fork. The same applies between the end of the impulse pin, also called the roller pin, and the surface of the dart facing said pin. The same attention must be given to the safety device between the other surface of the dart and the plate carrying the combined unit.

In numerous movements, the pallet/balance settings are insufficient, which causes a risk of collision, and these settings are in general out of balance.

It is clear that making these safety devices too large is detrimental to the total thickness of the movement, the section of whose components is constant?.

A compromise must therefore be found between operating safety, to prevent any risk of collision, and the total thickness of the movement.

It is not always easy to move components in order to provide safety devices, because of the presence of various bridges, the balance felloe, and other mechanisms with which there is a risk of interference, for example the date discs, which form a barrier preventing stones or incablocs from being moved to provide for security devices, particularly because of the safety device required between the balance felloe and the oscillating weight, which is provided by platforms in a fixed position, and which prevent the balance felloe being moved axially.

Further, the conventional solution is to provide adequate safety devices and settings, to the detriment of the thickness of the movement.

U.S. Patent No. 2010/157743 in the name of Roger Dubuis discloses a particular method of fixing the balance spring to the collet by matching a balance spring to a balance, and the assembly of the balance spring on the balance with a collet selected from among a collection of collets suited to different attachment distances of the inner coil relative to the staff. The balance thus includes a removable collet for attaching the balance spring. This balance includes a median seat, on each side of which are held bearing, on a first side, the balance beyond which a collet is driven in, and on a second side, a sleeve with the two rollers and the impulse pin.

CH Patent No 270582A in the name of Brendler discloses a conical balance staff onto which is fitted a first sleeve which carries, on a first side, a balance which bears on a first surface of the first sleeve forming a first seat and is immobilised by a first sharp rivet edge on the first end side of the staff, said first sharp rivet edge forming a second seat on which a collet is held bearing, the collet being immobilised by a sharp rivet edge at the first end of the first sleeve. The first sleeve also carries, on a second side, a second sleeve, which bears on a second surface of the first sleeve and carries balance rollers and is immobilised by a sharp rivet edge on the second end side of the first sleeve and corresponds to the second end of the balance staff.

FR Patent Application No. 1216100 A in the name of Pizon discloses several balance embodiments. In a first embodiment, a balance includes, on either side of a seat, on a first side, the balance supported on one surface and immobilised by the collet driven onto the staff, and on a second side a double roller mounted on a conical shoulder of the staff. The other embodiments include a sleeve with a single-piece double roller with a seat for the balance supported on one surface of the seat on the opposite side to the rollers, the collet abuts on a surface of the sleeve without any contact with the balance, and is mounted, depending upon the case, directly on the sleeve or on a threaded arbour on which the sleeve is mounted.

CH Patent No 95065 in the name of Koehn discloses a balance including, mounted on a smooth staff with a single shoulder, a sleeve including, beyond the two rollers, a balance-seat immobilised by a sharp rivet edge on the opposite side to the rollers, the collet being driven further onto the sleeve.

CH Patent No 474101 in the name of Fabriques de Balanciers Réunies discloses, a sleeve including a double roller, which is fitted onto a smooth staff, wherein the large roller with the impulse pin is also used as a direct support for the balance, which is immobilised on the opposite side by the collet driven onto the sleeve.

GB Patent No 831161 in the name of Smith, discloses a single-piece balance, with the pin and the notch on a first side of the felloe, and an off-centre collet on the other side of the felloe.

DE Patent No 2427021 SA1 in the name of Ebauches Bettlach discloses a balance staff including a seat with the notch, the balance felloe is supported on a surface of the seat and carries the impulse pin, the balance is held by the collet driven onto the staff.

U.S. Pat. No. 1,423,480, in the name of Needy, discloses several balance embodiments. In a first embodiment, a staff including a conical shoulder carries a first sleeve on which the balance is supported on an opposite side surface to the collet which is supported on said first sleeve, the first sleeve is held on the locally threaded conical staff by a nut in a recess in the first sleeve; and a second sleeve with a double roller and impulse pin is fitted onto a shoulder of the staff beyond the first sleeve. The other embodiment includes a ring screwed onto the staff underneath the first sleeve to hold the latter.

CH Patent Application No 700260 A2 in the name of Cartier discloses a single-piece staff with a median seat, on a first side of which the balance felloe bears, and beyond, the collet is fitted onto another shoulder, the seat forming the large roller carrying the impulse pin and the staff including the small roller on the second side opposite the balance.

SUMMARY OF THE INVENTION

The invention proposes to improve the safety devices between an equipped sprung balance assembly and a lever escapement mechanism. The object of the design of a particular type of balance is to improve the poising between the safety devices and the settings. The invention is of versatile nature, so as to be applicable to the conversion of existing movements, by modifying or replacing the smallest possible number of components.

Finally, the optimisation provided by the invention makes it easier to produce ultra-flat movements.

For a given movement height, the object of the invention is to balance the escapement settings and to increase the safety devices between the various components, to remove the risk of collisions.

The solution sought takes the utmost account of production costs, and strives to affect the minimum number of components.

To this end, the invention concerns a timepiece movement including at least one combined unit formed of a sprung balance assembly and a pallet lever, said sprung balance assembly comprising an equipped balance including a balance, whose hub is mounted on an equipped staff; said equipped staff includes a roller sleeve carrying a pin and at least one notch, and said roller sleeve being driven onto a shoulder of the roller of a timepiece balance staff, said staff including, about a main pivot axis:

a main shoulder for the radial centring of said balance, and, adjacent to said main shoulder, a first lateral bearing surface extending substantially radially and receiving said balance in axial abutment, a collet shoulder for the radial centring of a balance spring collet comprised in said sprung balance assembly, said collet shoulder and said main shoulder being at a distance from each other and arranged to maintain a distance from each other, said collet being mounted on said collet shoulder and said balance being mounted on said main shoulder, said staff forming a stepped hub including at both ends thereof, in proximity to end pivots, on the one hand, said roller shoulder, which is adjacent to a first radial shoulder, and on the other hand, said collet shoulder, which is adjacent to a second lateral surface, said first radial shoulder and said second lateral surface defining together a collar, said collar in turn including said main shoulder which is adjacent to said first lateral bearing surface for the axial bearing of said balance, and said first lateral bearing surface facing the same side as said first radial shoulder, and said balance shoulder being separated from said collet shoulder by a peripheral portion forming a seat, which forms the largest diameter of said collar and of said staff, the balance hub being mounted via a bore comprised in said main shoulder and also mounted bearing, via a first bearing surface of said balance, on said first lateral bearing surface, said hub being held, on a second surface of said balance axially opposite said first bearing surface, by a sharp rivet edge formed from a local deformation of a lip of said staff, said balance being confined between said first lateral bearing surface and said sharp rivet edge, the abutment limit of the balance being located on the opposite side to said roller shoulder and said sleeve being driven in on the opposite side to said balance relative to said sharp rivet edge, said balance spring collet, to which is attached at least one balance spring, being mounted by clamping on said staff and bearing in abutment on said second lateral surface, and said pallet lever being arranged to cooperate with said pin and said notch, and said pallet lever including a lever whose pivot defines a pallet lever pivot axis parallel to said main axis, said lever carrying a dart in the alignment thereof, and a set of horns arranged to cooperate with said pin as close as possible to said main shoulder, said dart being arranged to cooperate with said notch as far as possible from said main shoulder, and said set of horns being arranged in a substantially parallel plane to a plane defined by said lever and said dart, characterized in that said movement includes a plate carrying a first pallet-stone, and a pallet bridge carrying a second pallet-stone, said pallet lever is pivotally guided between said pallet-stones, said plate carrying a first shock resistant balance guide member including first means for the pivotal guiding of said staff about said main axis, and said movement including a balance bar carrying a second shock resistant balance guide member including second means for the pivotal guiding of said staff about said main axis, said sprung balance assembly being pivotally guided between said shock resistant guide members, and in that said dart is closer than said horns to the shock resistant guide member which is farthest from said balance spring.

The invention also concerns a timepiece including at least one such timepiece movement.

BRIEF DESCRIPTION OF THE DRAWINGS

Other features and advantages of the invention will appear upon reading the following detailed description, with reference to the annexed drawings, in which.

DETAILED DESCRIPTION OF PREFERRED EMBODIMENTS

Figure 1:
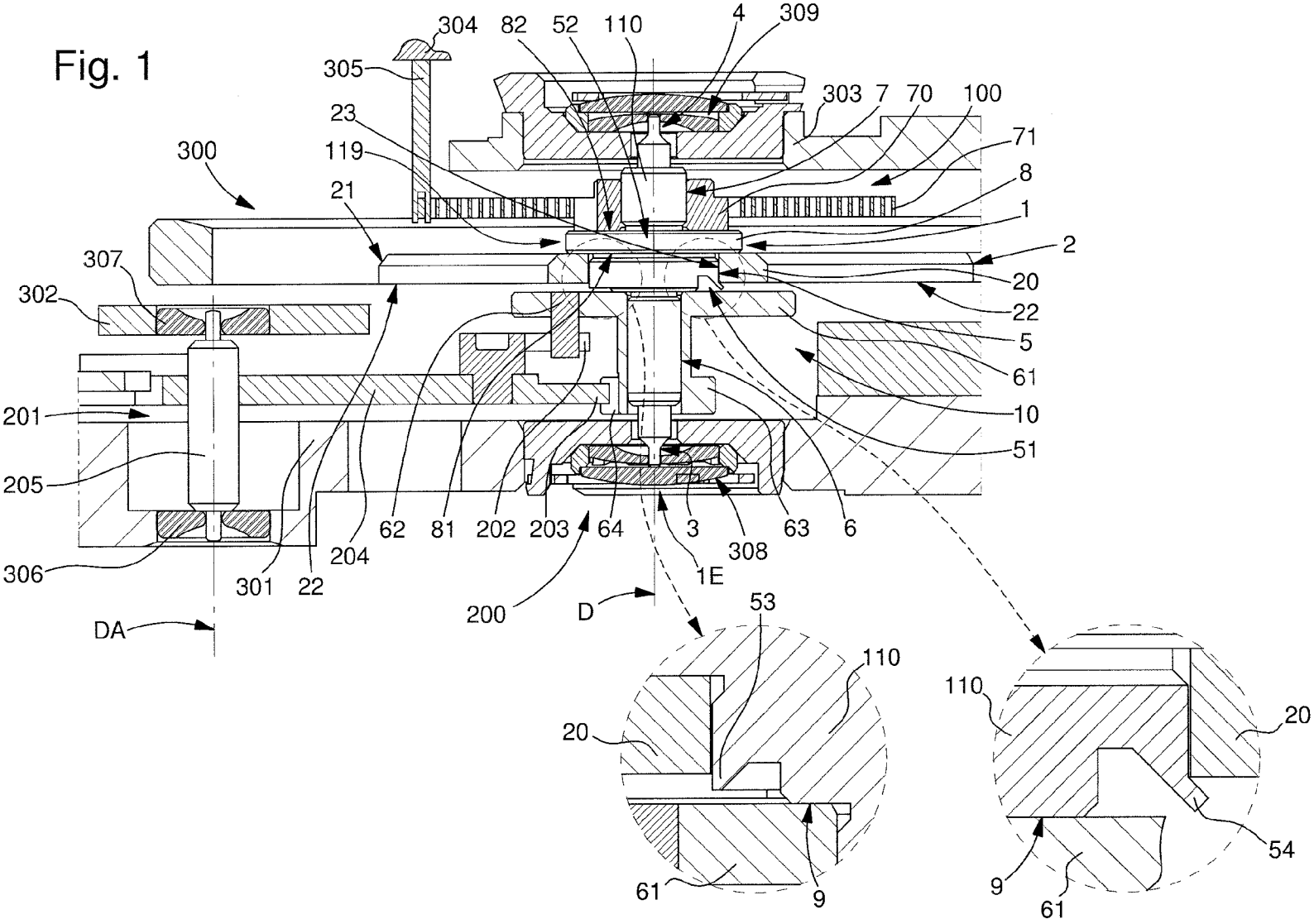
FIG. 1 shows a partial schematic cross-section through the pivot axis of a balance and through the pivot axis of a pallet lever cooperating with said balance, of a timepiece movement including a sprung balance assembly and a lever escapement mechanism, with a first preferred variant embodiment of a balance according to the invention.

The invention concerns the field of timepiece mechanisms, and more specifically the field of combined units with a sprung balance and lever escapement mechanism.

The invention proposes to improve the safety devices between an equipped sprung balance assembly and a lever escapement mechanism.

The invention first of all concerns a timepiece balance staff 1, illustrated in FIGS. 1 and 2 to 9, respectively showing a first preferred variant and other non-limiting variants of the invention.

The monolithic axial component guided by pivots on the plate and the bar, which carries the other components of the sprung balance will be referred to here as "staff 1". Depending upon its shape and structure, this staff 1 will be designated 11 (smooth) or 110 (stepped).

A sub-assembly, which is in a kit or pre-assembled, ready to receive a balance and a balance spring collet and including at least one staff 1 and one sleeve 60 with at least one roller notch 64, will be referred to here as "equipped staff 1E". In some variants, as seen in FIGS. 6 to 9, equipped staff 1E also includes components which have to be assembled at the same time as the balance and the balance spring collet: the added seat 89, spacer sleeve 111, spacer ring 208, whose function will be explained below.

An equipped staff 1E on which a simple balance 2 is assembled will be referred to as "equipped balance 10".

An assembly formed of an equipped balance 10 and at least one balance spring 7 will be referred to as "sprung balance assembly 100"

Timepiece balance staff 1 includes, about a pivot axis D:

- a main shoulder 5 or 65 for the radial centring of a balance 2, and, adjacent to main shoulder 5 or 65, a first lateral bearing surface 81 or 66, which extends substantially radially to receive balance 2 in axial abutment;
- a roller shoulder 6 for the radial centring of a roller sleeve 60. "Roller sleeve 60" refers to a sleeve with at least one roller notch.
- a collet shoulder 7 for the radial centring of a balance spring collet 70.

According to the invention, collet shoulder 7 and main shoulder 5 or 65 are at a distance from each other, and arranged so as to maintain at a distance from each other a collet 70 mounted on collet shoulder 7 and a balance 2 mounted on main shoulder 5 or 65. Staff 1 includes a second lateral bearing surface 82 or 68 for receiving in axial abutment a balance spring collet 70 mounted on collet shoulder 7. This second lateral bearing surface 82 or 68 is located, either on a seat 8 located between collet shoulder 7 and main shoulder 5 or 65, or on a radial shoulder of staff 1 beyond the projection of main shoulder 5 or 65, on axis D.

The different variants include a main shoulder supporting the balance, referenced main shoulder 5 in FIGS. 1, 4, 5, 6 and 7, where the main shoulder is directly arranged on an arbor 11 or stepped hub 110 forming the core of staff 1. This main shoulder is referenced 65 in FIGS. 2, 3, 8 and 9, where the main shoulder is arranged on a component added to arbor 11 or hub 110, said added component being a roller sleeve 60 in FIGS. 2 and 3, or a spacer sleeve 111 in FIGS. 8 and 9. In both cases, this main shoulder is used for the radial centring of hub 20 of a balance 2. Staff 1 includes, adjacent to main shoulder 5 or 65, a first lateral bearing surface. This first lateral bearing surface is referenced 81 in FIG. 1 and in FIGS. 6 to 9, where it is formed by a lateral surface of an added seat 89 or of a spacer sleeve 111. This first lateral bearing surface is referenced 66 in FIGS. 2 to 5. In both cases, this first lateral bearing surface extends substantially radially, preferably radially and perpendicularly to axis D of staff 1, to receive in axial abutment the hub 20 of a balance 2.

In all the variants illustrated here, balance staff 1 carries spacer means formed either by a shoulder of an arbor 11, or by a stepped hub 110 forming the core of said staff 1; or by a component added to said staff, such as seat 8, added seat 89, spacer sleeve 111, spacer ring 208, or added roller sleeve 60. The spacer means prevents collet 70 from bearing directly on the balance felloe as in conventional configurations.

Staff 1 includes a second lateral bearing surface for receiving in axial abutment a balance spring collet 70 mounted on collet shoulder 7. This second lateral bearing surface is referenced 82 in FIG. 1 and in FIGS. 6 to 9, where it forms the lateral surface of added seat 89 opposite first lateral bearing surface 81. The second lateral bearing surface is referenced 68 in FIGS. 2 to 5 where it is formed, in FIGS. 2 and 3, by an end surface of a roller sleeve 60 driven onto a rectilinear arbor 11, and, in FIGS. 4 and 5, by a shoulder of a collar of a stepped hub 110 peculiar to these variants.

It is an object of the invention to increase safety devices. A conventional impediment, linked to an ordinary assembly with the stacking, in series, of a collet bearing on a felloe, which in turn bears on a seat, which bears on a roller sleeve, results from the large space required for the seat which is situated between the felloe and the roller sleeve (or the large roller carrying the impulse pin). The invention therefore proposes several configurations for placing the balance hub and roller closer together, by removing from this area, the conventional seat between the felloe and the roller, and moving these latter elements as close as possible to each other, while providing the necessary safety devices. The straightforward removal of the seat is possible, but is not necessary to achieve the object of the invention. Indeed, the bearing surface function, which is traditionally attributed to the seat between the hub and roller of the prior art, may be performed by other components as is seen in the different variants.

Several configurations are possible for receiving a hub 20 of balance 2.

The FIG. 1 variant inverts the usual prior art system of positioning and fixing the balance by 180°. This inversion saves space height-wise between the small and large rollers. Seat 8 is transferred to the other side of the balance, i.e. it is inserted between hub 20 of the felloe of balance 2 and collet 70 for securing balance spring 71. Seat 8 is used as a support, on one side for collet 70, and on the opposite side for hub 20. Seat 8 forms the largest diameter of staff 1.

FIG. 1 therefore illustrates a first embodiment with a staff 1, which includes a single-piece stepped hub 110, which incorporates a collar 119 carrying seat 8.

On the hub 20 side, one of the lateral surfaces of seat 8 forms a first lateral bearing surface 81 for the axial abutment of hub 20 driven onto a main shoulder 5 of stepped hub 110. This main shoulder 5 is immediately next to said seat 8 and both are carried by collar 119.

On the side of staff 1 carrying collet 70, seat 8 has a radial shoulder defining a second lateral surface 82 for receiving in axial abutment said collet 70, mounted on a shoulder 7 comprised in staff 1.

Stepped shoulder 110 also includes, in immediate proximity to first radial shoulder 51, a lateral stop surface 9 for receiving in axial abutment an added balance roller sleeve 60, mounted on roller shoulder 6; on the side carrying hub 20, away from seat 8, main support shoulder 5 of hub 20 is interrupted by a first radial shoulder, defining a first axial side 51, in proximity to which a lateral stop surface 9 is arranged to act as bearing surface for a roller sleeve 60 carrying at least one roller notch 64. The hub 20 is preferably fixed by a sharp rivet edge 53, folded down into position 54 after being fitted, as seen in FIG. 1. This sharp rivet edge is set back from lateral stop surface 9, to ensure that roller sleeve 60 is supported on lateral stop surface 9 and not on the sharp rivet edge, and thus to ensure precise dimensions on the interface with the pallets. Beyond lateral stop surface 9, a smooth shoulder 6 of staff 1 carries roller sleeve 60, including a large roller 61, a small roller 63, roller notch 64 in small roller 63, and pin 62 mounted in large roller 61 in a particular variant.

Thus, lateral stop surface 9 holds roller sleeve 60 at a distance from hub 20 mounted on main shoulder 5 and held in abutment on first lateral surface 81, and prevents any contact between said roller sleeve 60 and balance 2. In the variant of FIG. 1, roller sleeve 60 does not participate in the positioning or holding of hub 20, and may be independent of staff 1. The same applies to the other variants illustrated in FIGS. 7 to 9.

In short, in FIG. 1, staff 1 is a stepped hub 110, which includes at the two ends thereof, in proximity to pivots, a roller shoulder 6, which is adjacent to a first radial shoulder 51, and a collet shoulder 7, which is adjacent to a second lateral surface 82. This first radial shoulder 51 and said second lateral surface 82 together define a collar 119 which in turn includes a balance shoulder 5, which is adjacent to a first lateral bearing surface 81 for supporting balance 2.

According to the invention, the first lateral bearing surface 81 faces the same side as the first radial shoulder 51. The shoulder 5 of balance 2 is separated from collet shoulder 7 by a peripheral portion forming a seat 8 which forms the largest diameter of collar 119 and thus of staff 1. This external diameter of seat 8 is also preferably greater than the external diameter of collet 70.

The diameter of the main shoulder 5 supporting the balance is smaller than that of seat 8, and is greater than the diameters of roller shoulder 6 and of collet shoulder 7.

Collar 119 axially positions balance 2 and collet 70.

Seat 8 is unique.

The balance is therefore stopped on the opposite side to roller shoulder 6 and to rollers 61 and 63.

In a variant that is not illustrated, pin 62 is fixed to balance 2 instead of being fixed to sleeve 60. This embodiment is applicable to all of the variants illustrated.

In another embodiment that is not illustrated, sleeve 60 and balance 20 form a single-piece component. This embodiment is applicable to the variants of FIGS. 1 to 4.

In FIGS. 2 to 5 however, the roller sleeve 60 necessarily forms part of balance staff 1, since it participates in supporting hub 20. Roller sleeve 60 is a component added to a rectilinear arbour 11 in FIGS. 2 and 3, and to a stepped hub 110 in FIG. 4. In the FIG. 5 variant, the roller sleeve, or at least the small roller 63 is integrated in a stepped hub 110 which directly carries hub 20.

Figure 4:
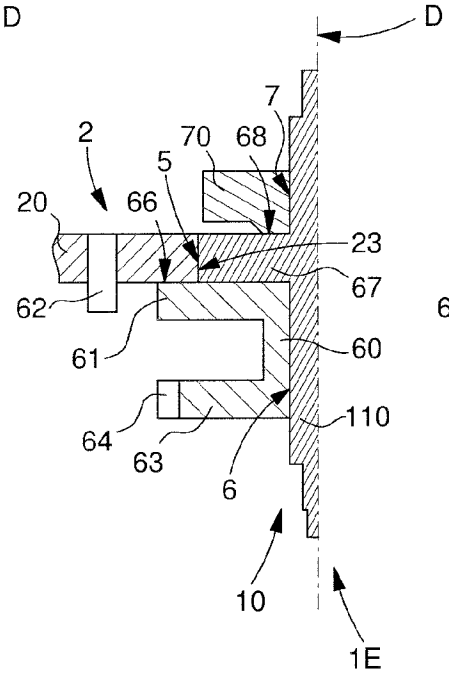
Figure 3:
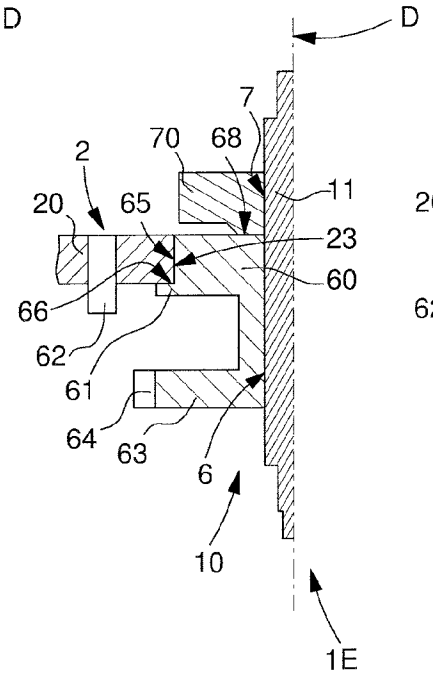
FIG. 3 shows a schematic, partial cross-section through the pivot axis of a third balance variant according to the invention.
Figure 2:
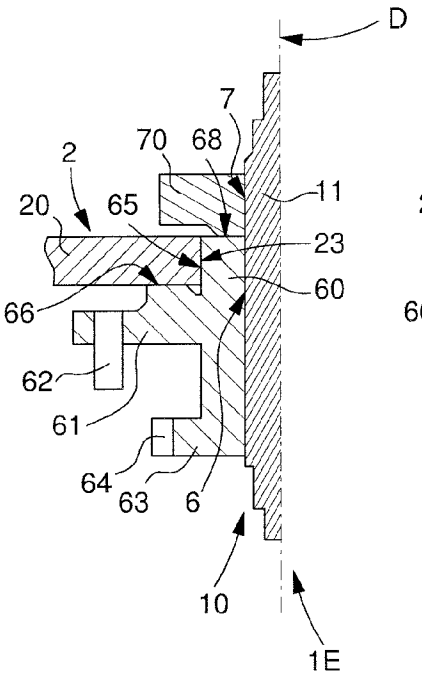
FIG. 2 shows a schematic, partial cross-section through the pivot axis of a second balance variant according to the invention.

In the case of FIGS. 2 to 4, staff 1 is thus in two parts and includes a roller sleeve 60 driven onto roller shoulder 6 comprised in an arbour 11, roller 60 being arranged to form a stop member supporting a balance 2 mounted on main shoulder 5 and held in abutment on first lateral surface 81.

In FIG. 2, as in FIG. 3, the seat supporting the balance is comprised within sleeve 60 carrying the double roller; the balance is fixed relative to said sleeve 60. Staff 1 is in two parts and includes a roller sleeve 60 driven onto roller shoulder 6 comprised in a rectilinear arbour 11, roller 60 including a first lateral bearing surface 66 forming a stop member for a balance 2 mounted on main shoulder 65 also comprised in roller sleeve 60. The end surface 68 of the double roller of sleeve 60 is used as an axial support for collet 70.

The FIG. 3 embodiment, with pin 62 in balance 20, is even more advantageous than in FIG. 2, since it saves space height-wise and allows for a very compact sprung balance assembly in the axial direction.

In FIG. 4, staff 1 is in two parts and includes a roller sleeve 60 driven onto roller shoulder 6 comprised in a stepped hub 110, roller 60 including a first lateral bearing surface 66 forming a stop member for a balance 2, mounted on main shoulder 5 comprised in a collar 67 of stepped hub 110. Sleeve 60 forms an integral part of the balance staff, which is directly supported by and fixed to stepped arbour 110; large roller 61 is no longer used to carry pin 62, which is directly carried by balance 20, and this shoulder 61 can therefore have a smaller diameter, since it forms only a simple axial support for the balance.

Figure 5:
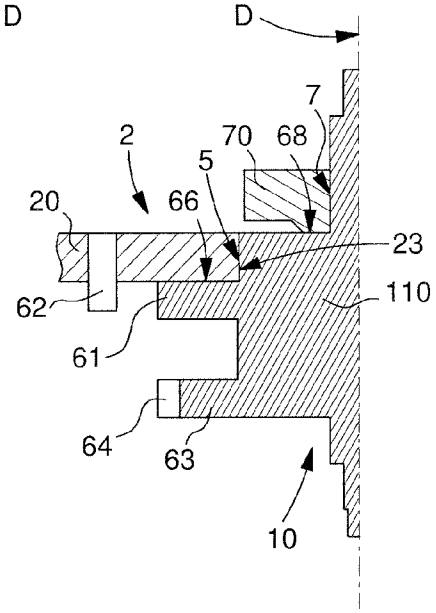
FIG. 4 and FIG. 5 show partial, schematic cross-sections through the pivot axis of a fourth variant with an added roller in FIG. 4, and of a fifth variant having a single piece staff with an integrated roller in FIG. 5.

The FIG. 5 variant differs from that of FIG. 1, in that it does not have a seat on the side of collet 70, and in that the only axial support for hub 20 is on a shoulder 66 of stepped hub 110. Staff 1 is a single part and includes a stepped hub 110, having a collar 61 which includes a first lateral bearing surface 66 forming a stop member for a balance 2 mounted on main shoulder 5 which is also comprised in collar 61.

To facilitate assembly, roller centring sleeve 6 preferably has a maximum diameter that is smaller than or equal to the minimum diameter of main shoulder 5 or 65.

In the embodiment of FIGS. 2 to 4, a roller sleeve 60 is driven onto roller shoulder 6, and includes at least the first lateral bearing surface 66 adjacent to the main shoulder. This main shoulder is formed either, in FIG. 4, by a main shoulder 5 comprised in a flange 67 projecting radially from arbour 11, or, in FIGS. 2 and 3, by a shoulder 65 comprised in roller 60 adjacent to first lateral bearing surface 66.

In a preferred embodiment, staff 1 is in a single piece and has a lateral stop surface 9 for receiving in axial abutment a balance roller sleeve 60 mounted on roller shoulder 6, so as to keep roller sleeve 60 at a distance from a balance 2, mounted on main shoulder 5 and held in abutment on first lateral surface 81.

Thus, in the first embodiment of FIG. 1, staff 1 is a single-piece stepped hub 110 and includes, on either side of main shoulder 5:

- a seat 8 whose diameter is greater than that of main shoulder 5, including first lateral surface 81 for receiving in axial abutment a balance 2, and second lateral surface 82 for receiving in axial abutment a balance spring collet 70, mounted on collet shoulder 7,
- a lateral stop surface 9, whose diameter is smaller than or equal to that of main shoulder 5, for receiving in abutment a balance roller sleeve 60, mounted on roller shoulder 6.

Staff 1 Preferably Includes:

- on a first axial side 51 of main shoulder 5, which is arranged for centring a balance 2 along a pivot axis D of staff 1, and away from main shoulder 5:
- at least one roller shoulder 6 for centring at least one roller on pivot axis D, roller shoulder 6 having a diameter smaller than or equal to that of main shoulder 5,
- a first pivotal guide means 3 about pivot axis D, whose diameter is smaller than or equal to the diameter of roller shoulder 6,
- on a second axial side 52, opposite first axial side 51 of main shoulder 5 and away from said shoulder 5;
  - collet shoulder 7 for the radial centring of at least one balance spring collet on pivot axis D,
- a second pivotal guide means 4 about pivot axis D, whose diameter is smaller than or equal to the diameter of collet shoulder 7.

Advantageously according to the invention:

- the first lateral bearing surface 81 which is arranged for receiving in abutment the felloe of a balance 2, and the second lateral bearing surface 82, form two faces of seat 8, axially opposite each other along pivot axis D,
- lateral stop surface 9 projects axially relative to main shoulder 5 towards roller shoulder 6.

In a preferred embodiment, main shoulder 5 includes, on a first axial side 51 facing roller shoulder 6, a lip 53 of small cross-section to form, by sharp rivet edgeing or heading or a similar method, a sharp rivet edge 54 for locking a hub 20 of a balance 2, mounted on main shoulder 5 in abutment on first lateral surface 81. FIG. 1 shows two details, with, to the left of pivot axis D, said sharp rivet edge 53 as manufactured, substantially parallel to axis D, so as to allow the assembly of hub 20 of balance 2. To the right of pivot axis D, however, this sharp rivet edge is shown in a folded over holding position on hub 20 at reference 54. These details show an upsetting groove allowing material to flow out when the operation to form sharp rivet edge 54 is carried out.

By way of alternative to forming a sharp rivet edge, it is possible to fix the balance felloe by other means, particularly by clamping it onto the arbour or onto the component carrying the main shoulder, by laser welding, brazing, bonding, local deformation of the arbour or of the component carrying the main shoulder, although these methods are in no way limiting.

In the variants of FIGS. 2 to 4, to carry hub 20, staff 1 is in two parts and includes a roller sleeve 60 driven onto roller shoulder 6 comprised in an arbour 11.

In the case of FIG. 4, hub 20 carries the impulse pin 62. Roller sleeve 60, which is added to arbour 11, is arranged to form a stop member for a balance 2 mounted in radial abutment on main shoulder 5 of arbour 11, and held in axial abutment on a shoulder 66 of a collar 61 of the roller sleeve 60, which is similar to a conventional large roller, but does not carry an impulse pin.

In FIGS. 2 and 3, hub 20 is in radial abutment on a shoulder 65 of roller 60 and in axial abutment on a shoulder 66 of a collar 61 of roller sleeve 60. In FIG. 2, this collar 61 forms a conventional roller carrying impulse pin 62. However, in FIG. 3, the collar does not form a conventional large roller carrying impulse pin 62, since, in a similar manner to the FIG. 4 variant, it is also hub 20 which carries impulse pin 62 in this variant.

FIG. 5 illustrates a single piece version having a stepped hub 110 with an integrated roller. Hub 20 carries impulse pin 62 and is in axial abutment on a surface 66 of a collar 61 of stepped hub 110 and in radial abutment on a shoulder 5 of said stepped hub 110.

In the embodiments of FIGS. 1 and 2, roller sleeve 60 includes a large roller 61, which carries an impulse pin 62, and is integral with a small roller 63 comprising a roller notch 64 and farther away than said large roller from the main shoulder, referenced 5 in FIG. 1, 65 in FIG. 2.

In the embodiments of FIGS. 3 and 4, hub 2 carries an impulse pin 62. Roller 60 carries a large roller 61 carrying the first lateral bearing surface 66, and which is integral with a small roller 63 comprising a roller notch 64 and farther away than said large roller from main shoulder 5, 65.

Figure 6:
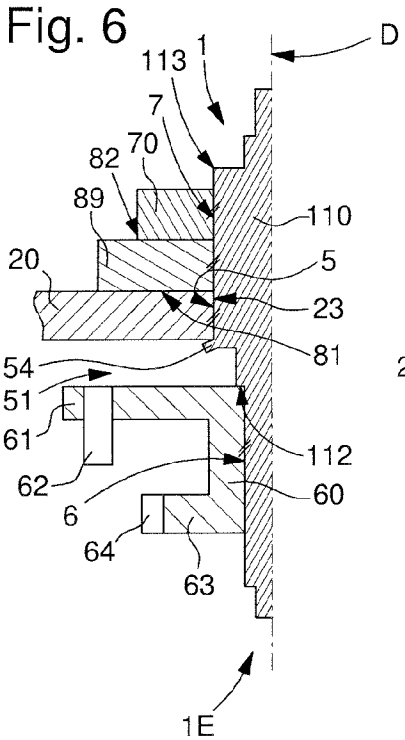
FIG. 6 shows a schematic, partial cross-section through the pivot axis of a sixth balance variant according to the invention.
Figure 10:
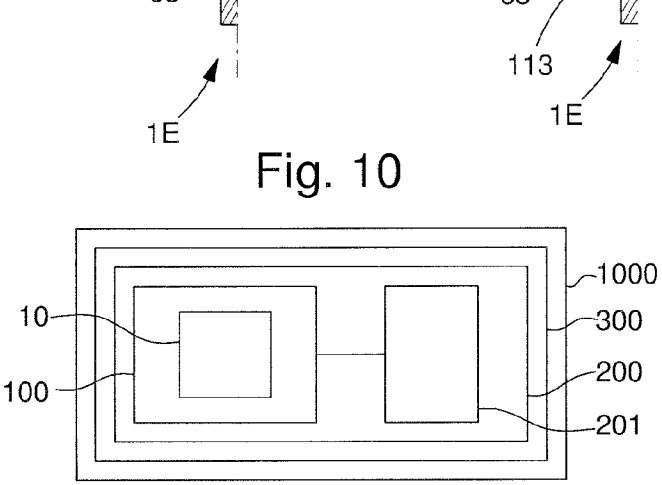
FIG. 10 shows, in the form of block diagrams, a timepiece comprising a timepiece movement with a sprung balance assembly and a lever escapement mechanism, with a balance according to the invention.

In FIG. 6, staff 1 is in two parts and includes an added seat 89, driven onto a rectilinear shoulder 113 comprised in a stepped hub 110, between main shoulder 5 and collet shoulder 7, the added seat 89 including a first lateral bearing surface 81 and a second lateral bearing surface 82. Rectilinear shoulder 113 includes, on a first axial side 51 facing roller shoulder 6, a lip 53 of small cross-section to form a sharp rivet edge 54 locking a hub 20 of a balance 2, mounted on main shoulder 5. Stepped shoulder 110 has a shoulder face 112 forming an axial stop member for a roller sleeve 60 mounted on roller shoulder 6 comprised in stepped hub 110.

The FIG. 6 variant includes an added seat 89 driven onto a stepped hub 110. The balance spring collet 70 is also driven onto stepped shoulder 110, in axial abutment on added seat 89 which in turn abuts on balance hub 20. This hub 20 is held on the opposite side by a sharp rivet edge 54, as in the FIG. 1 version. An added roller sleeve 60, including a conventional large roller 61 and conventional small roller 63, is driven onto stepped hub 110, abutting on a shoulder face 112.

Figure 7:
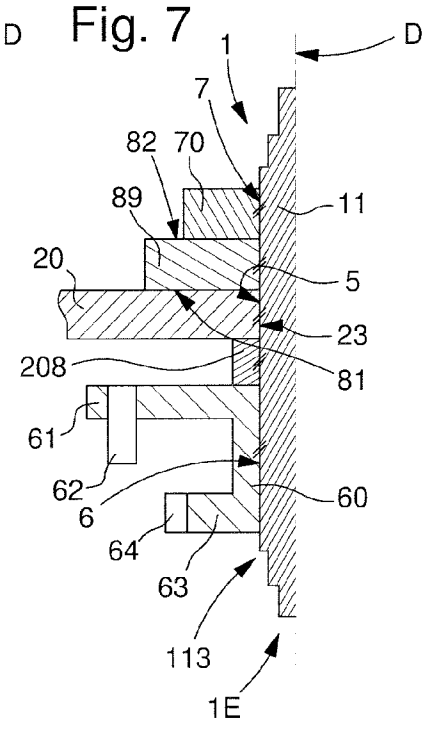
FIG. 7 shows a schematic, partial cross-section through the pivot axis of a seventh balance variant according to the invention.

In FIG. 7, staff 1 is in three parts and includes an added seat 89, intended to be driven onto a rectilinear shoulder 113 comprised in a rectilinear arbour 111 on either side of a balance 2, mounted on main shoulder 5 of rectilinear shoulder 113; said added seat 89 includes a first lateral bearing surface 81 and a second lateral bearing surface 82, and a spacer ring 208 forming an axial stop member for a roller sleeve 60 mounted on roller shoulder 6 of rectilinear shoulder 113.

The FIG. 7 variant concerns a staff 1 including a smooth, rectilinear arbour 11, onto which the following are driven: collet 70, in axial abutment on added seat 89, which is in turn in axial abutment on hub 20, which is in axial abutment on a spacer ring 208 with an added roller sleeve 60, including a conventional large roller 61 and a conventional small roller 63, carrying impulse pin 62 and notch 64.

Figure 8:
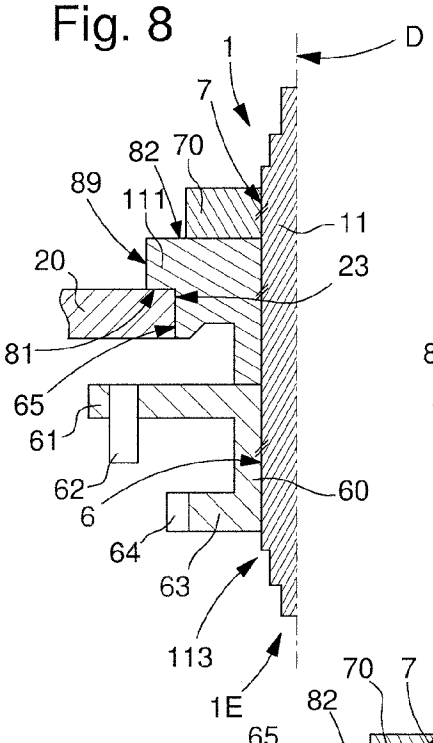
FIG. 8 shows a schematic, partial cross-section through the pivot axis of an eighth balance variant according to the invention.

In FIG. 8, staff 1 is in two parts and includes a spacer sleeve 111 between balance spring collet 7 and roller shoulder 6, the spacer sleeve 111 including a collar forming the support plate and including main shoulder 65 and first lateral bearing surface 81, the spacer sleeve being driven onto a rectilinear shoulder 113 comprised in a rectilinear arbour 11 between main shoulder 5 and collet shoulder 7, said added seat 89 further including a second lateral bearing surface 82, and spacer ring 111 forming an axial stop member for a roller sleeve 60 mounted on roller shoulder 6.

The FIG. 8 variant concerns a staff 1 including a smooth, rectilinear arbour 11, onto which collet 70 is driven, in axial abutment on spacer sleeve 111. This spacer sleeve 111 includes, underneath a collar forming a seat, the main shoulder 65 radially supporting hub 20, and a first lateral bearing surface 81 for the axial abutment of hub 20, on the opposite side to collet 70. Sleeve 111 is in axial abutment on an added roller sleeve 60, including a conventional large roller 61 and a conventional small roller 63, which carry impulse pin 61 and notch 64.

An advantageous variant of FIG. 8 consists in fixing pin 62 to balance 20 which means omitting large roller 61 and saving axial space height-wise, spacer sleeve 111 then abutting directly on a sleeve 60 limited to the small roller 63 provided with notch 64.

Figure 9:
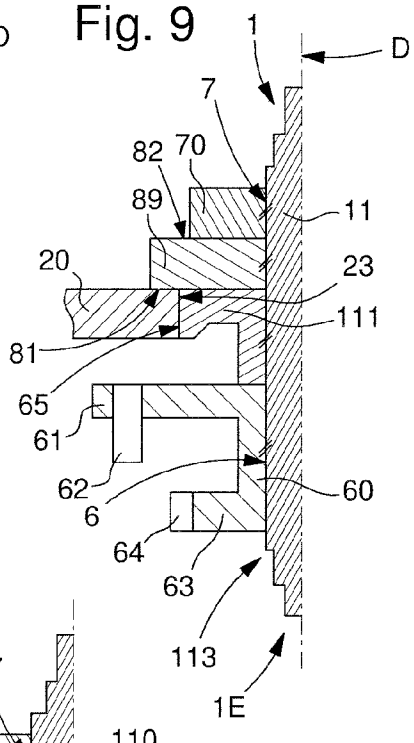
FIG. 9 shows a schematic, partial cross-section through the pivot axis of a ninth balance variant according to the invention.

In FIG. 9, staff 1 is in three parts and includes, driven side by side onto a rectilinear shoulder 113 comprised in a rectilinear arbour 11, an added seat 89, which includes a first lateral bearing surface 81 and a second lateral bearing surface 82, and a spacer sleeve 111 carrying main shoulder 65, said spacer sleeve 111 forming an axial stop member for a roller sleeve 60 mounted on roller shoulder 6.

The FIG. 9 variant concerns a staff 1 including a smooth, rectilinear arbour 11, onto which there are driven: collet 70, in axial abutment on an added seat 89, in axial abutment on a spacer sleeve 111. Added seat 89 includes the first lateral bearing surface 81 for the axial abutment of hub 20 on the opposite side to collet 70. Sleeve 111 includes main shoulder 65, radially supporting hub 20, and is in axial abutment on an added roller sleeve 60, including a conventional large roller 61 and a conventional small roller 63, carrying impulse pin 62 and notch 64.

Figure 11:
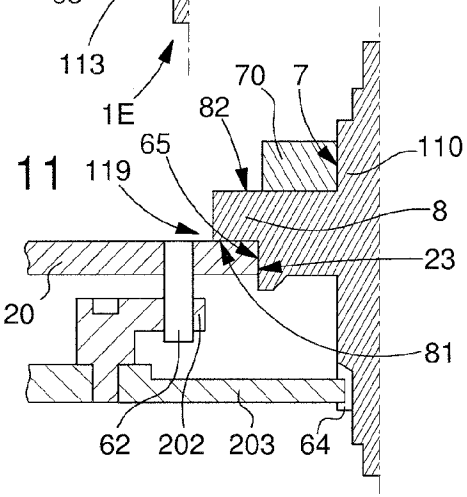
FIG. 11 shows a schematic, partial cross-section through the pivot axis of a ninth balance variant according to the invention.

The FIG. 11 variant illustrates a version close to that of FIG. 1, but wherein sleeve 60 is incorporated in the actual staff. Only notch 64 remains. The stepped single-piece arbour 110 includes a collar 119, which has a cylindrical shoulder 65 for housing hub 20, adjacent to a first lateral bearing surface 81 of the hub, and which faces notch 64 arranged at the foot of arbour 110. The other face of collar 119 includes a second lateral surface 82 for the axial abutment of collet 70, centred on a cylindrical shoulder 7 of arbour 110. Hub 20 carries pin 62, which cooperates with horns 202 of the inverted pallets, whereas dart 203 cooperates with notch 64.

Preferably, to facilitate assembly, the maximum diameter of the roller centring shoulder 6 is less than or equal to the minimum diameter of main shoulder 5, and arbour 1 includes a lateral stop surface 9 whose diametral dimensions are smaller than or equal to that of main shoulder 5, for receiving in abutment a balance roller 60 mounted on roller shoulder 6.

Naturally, the different variants illustrated are suited to holding hub 20 in place using sharp rivet edges, by local deformation of a roller sleeve 60, or of a collar 67, or of a stepped hub 110, or of a spacer sleeve 111, this securing method being shown only in FIGS. 1 and 4 for the sake of clarity. Preferably, the components concerned include, in the bare state, a lip extending parallel to axis D, intended to form this sharp rivet edge. Thus, in a particular embodiment of staff 1, one of its components includes a lip 53 of small cross-section to form a sharp rivet edge 54 locking a hub 20 of a balance 2 mounted on main shoulder 5 or 65 depending on the case.

The invention also concerns, in FIG. 1, an equipped staff 1E comprising a staff 1 which includes a roller sleeve 60 carrying at least one roller notch and is intended to be driven onto the roller shoulder 6 comprised in the stepped hub 110, said roller 60 including a first lateral bearing surface 66 forming a stop member for a balance 2 to be mounted on main shoulder 5 comprised in collar 119 of stepped hub 110.

The invention further concerns, for FIG. 1, an equipped timepiece balance 10 including a bare balance 2 whose hub 20 is mounted on an equipped staff 1E of this type. Hub 20 is mounted via a bore 23 comprised therein onto main shoulder 5, abutting via a first bearing surface 21 on the first lateral bearing surface 81 and held, on a second face axially opposite the first bearing face 21, either by a sharp rivet edge 54 derived from the local deformation of a lip 53 of staff 1, or by the irreversible fixing of staff 1 onto hub 20 in a fixing area. This equipped balance 10 includes an impulse pin 62 and at least one roller notch 64, roller pin 62 being mounted on hub 20, or on a roller sleeve 60 carrying at least one roller notch 64 and driven onto roller shoulder 6. Sleeve 60 is mounted after balance 2 has been inserted between the first lateral bearing surface 81 and sharp rivet edge 24 or the fixing area.

The invention further concerns an equipped timepiece balance 10 including a bare balance 2 whose hub 20 is mounted on a staff 1 of this type. Hub 20 is mounted, via a bore comprised therein, and driven onto main shoulder 5, abutting via a first bearing face 21 on the first lateral bearing surface 81 of seat 8. In the preferred variant of FIG. 1, hub 20 is held, on a second face axially opposite the first bearing face 21, either by a sharp rivet edge 54 derived from the local deformation of a lip 53 of staff 1, or by the irreversible fixing of staff 1 onto hub 20 in a fixing area.

This equipped balance 10 includes an impulse pin 62 and a roller notch 64, roller pin 62 being mounted on hub 20, either on a roller sleeve 60 driven onto a roller shoulder 6, and roller notch 64 being arranged on staff 1, or on a roller sleeve 60 driven onto roller shoulder 6.

Preferably, staff 1 has a lateral stop surface 9, which projects axially on pivot axis D relative to sharp rivet edge 54 or to the fixing area, for receiving in axial abutment a balance roller sleeve 60, or a large roller 61 comprised in said sleeve 60 clamped onto roller shoulder 6, so as to keep roller sleeve 60 at a distance from a balance 2, mounted on main shoulder 5 and held in abutment on first lateral surface 81.

In a particular embodiment, hub 20 is secured by irreversible welding, or brazing or bonding to staff 1.

The invention further concerns a sprung balance assembly 100 including an equipped balance 10 of this type, comprising an impulse pin 62 and a roller notch 64. The assembly includes, clamped onto staff 1 and in abutment on the second lateral surface 82 or 68, a balance spring collet 70, to which at least one balance spring 71 is attached.

The invention further concerns a timepiece combined unit 200 including a sprung balance assembly 100 of this type, and including an equipped balance 10 of this type carrying an impulse pin 62 and a roller notch 64 and further including pallets 201 arranged to cooperate with the impulse pin 62 and roller notch 64. Pallets 201 are pivotally mounted about a pallet axis DA parallel to pivot axis D of staff 1 and include horns 202 arranged to cooperate with impulse pin 62 as closely as possible to main shoulder 5, and a dart 203 arranged to cooperate with roller notch 64 as far away as possible from main shoulder 5.

Preferably, pallets 201 include a lever 304, which may or may not be integral with pivot 205 defining the pallet axis DA, lever 204 carrying the dart 203 in the alignment thereof, and carrying an added set of horns 202 in a plane substantially parallel to a plane defined by lever 204 and dart 203.

The invention also concerns a timepiece movement 300 including at least one combined unit 200 of this type; it includes a bottom plate 301 carrying a first pallet stone 306 and a pallet cock 302 carrying a second pallet stone 307, pallets 201 being pivotally guided between said pallet stones 306, 307. Bottom plate 301 carries a first balance shock absorber guide means 308 and movement 300 includes a balance bar 303 carrying a second balance shock absorber guide means 309. The sprung balance assembly 100 is guided between these shock absorber guide means 308, 309, and dart 203 is closer than horns 202 to whichever shock absorber guide means 308, 309 is farthest from balance spring 71.

It is clear that the relative assembly of the dart and horns according to the invention, wherein the horns are mounted off-centre, in a parallel plane to the plane of the fork which carries the dart, is the reverse of the conventional assembly where the dart is inserted parallel to the fork carrying the horns in the same plane as said fork.

The invention also concerns a timepiece 1000 including at least one such timepiece movement 300.

The relative arrangements for holding the balance felloe, by the seat as arranged in FIG. 1 or 6 to 9, or by the rollers of FIGS. 2 to 4, allow the fixing and positioning system to be inverted by 180° with respect to the prior art. Without changing the position of the bars, it is therefore possible to increase the safety devices, particularly between the balance and the oscillating weight, without increasing the height of the movement. To achieve the object of poising the settings and increasing the security devices, between the large roller and the pallet lever, between the pin and the dart, and between the dart and the bottom plate, in addition to inverting the abutment of the balance on its staff, the relative positions of the dart and horns on the pallets must also be inverted. This combination alone allows the relative positions of the other components of the movement: bars, oscillating weight, date disc, incabloc system, to be maintained.

The invention has the advantage of providing an interchangeable set solution, i.e. the new pallets, which are inverted with respect to the conventional position, and the balance according to the invention, may be mounted in a movement which it is proposed to improve, without thereby modifying other components. This notion of interchangeability is economically very important.

The invention provides an economical solution to controlling the height of the movement, while ensuring high safety and setting values, since it only requires action on two components: the balance staff and the pallets.

The invention therefore facilitates the production of ultra-flat movements, with components that are as rigid as those in conventional movements, and without any risk during operation.

What is claimed is:

1. A timepiece movement including at least one combined unit formed of a sprung balance assembly and a pallet lever, said sprung balance assembly including an equipped balance having a balance hub of which is mounted on an equipped staff, said equipped staff includes a roller sleeve which carries an impulse pin and at least one notch, and said roller sleeve being driven onto a roller shoulder of a timepiece balance staff, said staff including, about a main pivot axis:

a main shoulder for the radial centring of said balance, and, adjacent to said main shoulder, a first lateral bearing surface extending substantially radially and receiving said balance in axial abutment;

a collet shoulder for the radial centring of a balance spring collet comprised in said sprung balance assembly, said collet shoulder and said main shoulder being at a distance from each other and arranged to maintain a distance from each other, said collet being mounted on said collet shoulder, and said balance being mounted on said main shoulder, said staff forming a stepped hub including at both ends thereof, in proximity to end pivots, on the one hand, said roller shoulder, which is adjacent to a first radial shoulder, and on the other hand, said collet shoulder, which is adjacent to a second lateral surface, said first radial shoulder and said second lateral surface defining together a collar, said collar in turn including said main shoulder which is adjacent to said first lateral bearing surface for the axial bearing of said balance, and said first lateral bearing surface facing the same side as said first radial shoulder, and said balance shoulder being separated from said collet shoulder via a peripheral portion forming a seat which forms the largest diameter of said collar and of said staff the balance hub being mounted via a bore comprised in said hub on said main shoulder and also mounted bearing, via a first bearing surface comprised in said balance, on said first lateral bearing surface, said hub being held, on a second surface of said balance axially opposite to said first bearing surface, via a sharp rivet edge resulting from local deformation of a lip of said staff, said balance being confined between said first lateral bearing surface and said sharp rivet edge, the abutment limit of the balance being located on the opposite side to said roller shoulder, and said sleeve being driven in on the opposite side to said balance relative to said sharp rivet edge, said balance spring collet, to which is attached at least one balance spring, being mounted by clamping on said staff, and bearing in abutment on said second lateral surface, and said pallet lever being arranged to cooperate with said impulse pin and said notch, and said pallet lever including a lever whose pivot defines a pallet lever pivot axis parallel to said main axis, said lever carrying a dart in the alignment thereof, and a set of horns arranged to cooperate with said impulse pin as close as possible to said main shoulder, said dart being arranged to cooperate with said notch as far as possible from said main shoulder, and said set of horns being arranged in a substantially parallel plane to a plane defined by said lever and said dart, wherein said movement includes a bottom plate carrying a first pallet stone, and a pallet bridge carrying a second pallet stone, said pallet lever being pivotally guided between said pallet stones, said bottom plate carrying a first shock resistant balance guide member including first means of pivotally guiding said staff about said main axis, and said movement including a balance bar carrying a second shock resistant balance guide member including second means of pivotally guiding said staff about said main axis, said sprung balance assembly is pivotally guided between said shock resistant guide members, and in that said dart is closer than said horns to said shock resistant guide member which is farthest from said balance spring.

2. The movement according to claim 1, wherein the diameter of said balance shoulder is smaller than that of said seat, and is greater than the diameters of said roller shoulder and of said collet shoulder.

3. The movement according to claim 1, wherein there is only one said seat.

4. The movement according to claim 1, wherein said staff is in a single piece and, in immediate proximity to said first radial shoulder, has a lateral stop surface for receiving in axial abutment said sleeve so as to hold said roller sleeve at a distance from said balance which is mounted on said main shoulder and held bearing on said first lateral surface.

5. The movement according to claim 1, wherein the maximum diameter of said roller shoulder is less than or equal to the minimum diameter of said main shoulder, and in that said staff has a lateral stop surface whose diameter is less than or equal to that of said main shoulder for receiving in axial abutment said balance roller sleeve.

6. The movement according to claim 1, wherein said hub is held by irreversible welding, brazing or bonding on said staff.

7. The movement according to claim 1, wherein said external diameter of said seat is greater than the external diameter of said collet.

8. The timepiece including at least one timepiece movement according to claim 1.

* * * * *